US005168029A

United States Patent [19]

Igarashi et al.

[11] Patent Number: 5,168,029

[45] Date of Patent: Dec. 1, 1992

[54] MULTICOLOR RECORDING MATERIAL

[75] Inventors: Akira Igarashi; Yutaka Fujita, both of Shizuoka, Japan

[73] Assignee: Fuji Photo Film Co., Ltd., Kanagawa, Japan

[21] Appl. No.: 474,568

[22] Filed: Feb. 2, 1990

[30] Foreign Application Priority Data

Feb. 3, 1989 [JP] Japan ..... 1-25251

[51] Int. Cl.[5] ..... G03C 1/72

[52] U.S. Cl. ..... 430/138; 430/214; 430/215; 430/224; 430/332; 430/340; 430/338

[58] Field of Search ..... 430/138, 332, 340, 338; 503/215, 214, 224

[56] References Cited

U.S. PATENT DOCUMENTS

| | | | |
|---|---|---|---|
| 4,598,036 | 7/1986 | Iwasaki et al. | 430/338 |
| 4,929,530 | 5/1990 | Saeki et al. | 430/138 |
| 4,965,166 | 10/1990 | Hosoi et al. | 430/142 |
| 4,985,331 | 1/1991 | Saeki et al. | 430/138 |

*Primary Examiner*—Charles L. Bowers, Jr.
*Assistant Examiner*—Thorl Chen
*Attorney, Agent, or Firm*—Sughrue, Mion, Zinn, Macpeak & Seas

[57] ABSTRACT

A multicolor recording material is disclosed, which comprises a support having provided thereon at least two layers each containing a leuco dye which is capable of forming a color by oxidation and a photo-oxidizing agent, wherein the leuco dyes contained in each layer are capable of forming different color from each other and the photo-oxidizing agents contained in each layer respond to light having different wavelength from each other. Another multicolor recording material is also disclosed, which comprises a support having provided thereon a layer containing at least two kinds of heat-responsive microcapsules which have different response temperature from each other, each containing a leuco dye which is capable of forming a color by oxidation and a photo-oxidizing agent, wherein the leuco dyes contained in each kind of microcapsule are capable of forming different color from each other and the photo-oxidizing agents contained in each kind of microcapsule respond to light having different wavelength from each other.

6 Claims, No Drawings

MULTICOLOR RECORDING MATERIAL

FIELD OF THE INVENTION

This invention relates to a multicolor recording material and, more particularly, to a recording material permitting multicolor recording using light or heat.

BACKGROUND OF THE INVENTION

As the most popular process for obtaining multicolor images, silver salt photography has so far been widely used in practice. However, silver salt photography has defects in that it requires dark-room working and in that processing with a developer is required after imagewise exposure.

In order to remove these defects, JP-A-59-48764 (the term "JP-A" as used herein means an "unexamined published Japanese Patent Application"), etc. describe dry-process silver salt photographic light-sensitive materials, British Patent 249530, U.S. Pat. Nos. 2,020,775, 2,004,625, 2,217,544, 2,255,463, 2,699,394, etc. describe dye diffusion transfer process photographic light-sensitive materials, and U.S. Pat. No. 2,844,574, etc. describe silver dye bleach process photographic light-sensitive materials.

On the other hand, as recording materials not using silver salts, electrophotographic systems in which an apparatus equipped with a multicolor recording mechanism, a heat-sensitive transfer system, an ink-jet system, and the like is employed. However, these have defects in that large-sized equipment is required, that recording reliability is insufficient, and that exchange of expendables is troublesome.

Recently, thermal recording has been noted as a simple and maintenance-free recording system, and multicolor recording using heat-sensitive recording material is being studied. For example, JP-B-51-19989 (the term "JP-B" as used herein means an "examined Japanese patent publication") (corresponding to British Patent 1409831), JP-B-52-11231, JP-A-54-88135, JP-A-55-133991, JP-A-55-133992, etc. describe multicolor heat-sensitive recording materials which, however, use a plurality of heat-sensitive recording materials having different coloration temperatures and therefore provide colors by color mixing, which has disadvantages. In order to overcome this defect, there is a process using a decolorizing mechanism. A decolorizing agent acts on a color-forming unit capable of forming color at a lower temperature simultaneously when a color-forming unit having a higher heat response temperature forms color, as described in, for example, JP-B-50-17868 (corresponding to U.S. Pat. No. 3,843,384), JP-B-51-5791, JP-B-57-14318 and JP-B-57-14319. However, this process has a defect in that a hue of color which is to be formed at a lower temperature is undesirably formed also at the edge of an image which is formed at a higher temperature, thus it is not suited for multicolor recording.

As multicolor recording materials overcoming the above-described defects, recording materials wherein heat-sensitive coloration system, light-sensitive coloration system, etc. are combined are described in Japanese Patent Application No. 61-80787, JP-A-63-172681, JP-A-63-45084 (corresponding to British Patent 8807887), JP-A-63-134282, etc. They comprise a transparent support having provided on one side thereof at least one color-forming unit layer and on the other side at least one color-forming unit layer capable of forming a color of different hue from that of the above-described unit layer, said color-forming units containing a combination of a diazo compound and a coupler as a color-forming component and/or a combination of a leuco dye and a color-developer as a color-forming component.

However, these recording materials still involve many unsatisfactory points in that transparent supports are necessary, and that, since diazo compounds are used, they have a short usable period (life) after their production.

SUMMARY OF THE INVENTION

An object of the present invention is to provide a multicolor recording material based on a novel idea different from conventional ones.

The above-described object of the present invention can be attained by a multicolor recording material comprising a support having provided thereon a layer or layers containing (1) at least two leuco dyes, each of which is capable of forming a color with different hue by oxidation and (2) at least two photo-oxidizing agents, each responding to different wavelength of light.

That is, the present invention relate to a multicolor recording material comprising a support having provided thereon at least two layers each containing a leuco dye which is capable of forming a color by oxidation and a photo-oxidizing agent, wherein the leuco dyes contained in each layer are capable of forming different color from each other and the photo-oxidizing agents contained in each layer respond to light having different wavelength from each other.

The present invention further relate to a multicolor recording material comprising a support having provided thereon a layer containing at least two kinds of heat-responsive microcapsule which have different response temperature from each other, each containing a leuco dye which is capable of forming a color by oxidation and a photo-oxidizing agent, wherein the leuco dyes contained in each kind of microcapsule are capable of forming different color from each other and the photo-oxidizing agents contained in each kind of microcapsule respond to light having different wavelength from each other.

DETAILED DESCRIPTION OF THE INVENTION

Leuco dyes of various structures are known which are normally colorless or slightly colored and, when oxidized, form different colors encompassing about the entire visible region. Photo-oxidizing agents capable of generating radicals upon irradiation with light which in turn oxidize a leuco dye have also been studied, and among them are many that are stable to energy other than light. Recording materials able to record using a light of specific wavelength can be obtained by combining the leuco dyes and the photo-oxidizing agents. The specific wavelength of the light generally depends upon the kind of the photo-oxidizing agent used in the recording material. For examples, as the photo-oxidizing agent, a compound having a trifluoromethyl group (e.g., 2,6-ditrichloromethyl-4-(p-methoxyphenoxy)triazine) generally responds to the light having wavelength of 380 nm or below, and it thereby oxidize the leuco dye coexisting therewith to form a color. Further, a lophine dimer compound (e.g., 2,4,5-triphenylimidazole dimer) generally responds to the light having wavelength of 500 nm or below, and it thereby oxidize the leuco dye coexisting therewith to form a color. (Detailed descriptions are given in The Photographic Society of Japan, *Shashin Kogaku-no-Kiso-Higin en Shashin Hen- (Basis of Photographic Engineering-Non-silver salt Photography)*, published by Korona K.K., pp. 77–89 (1982)).

A multicolor image can be obtained utilizing this reaction by, for example, forming a multi-layer structure wherein leuco dyes which are capable of forming colors with different hues are incorporated in individual layers and are associated with photo-oxidizing agents responding to different wavelength light, and conducting image recording using corresponding wavelength light. After image recording, the image may be fixed by treating the recorded layers with a reducing agent. For example, the multicolor recording material, which can form red color by exposure with the light having wavelength of from 380 to 500 nm, and can form black color (the mixture of red with green) by exposure with the light having wavelength of 380 nm or below, can be obtained by coating onto a support the layer comprising the leuco dye which is capable of forming green color and the photo-oxidizing agent having trihalomethyl group, and the layer comprising the leuco dye which is capable of forming red color and a lophine dimer compound, as the photo-oxidizing agent. The recorded image thereof can be fixed by, for example, immersing the recording material into a solution containing a reducing agent to prevent undesired coloration, by another exposure with light, at the portion which has not been formed the image.

The object of the present invention can be more effectively attained by utilizing a microencapsulation technique. That is, microencapsulation of the leuco dye which is capable of forming a color by oxidation and the photo-oxidizing agent eliminates the necessity of the aforementioned multilayered structure. Fixing may be conducted by allowing a reducing agent to exist outside the capsules and, after imagewise recording using light, applying pressure thereto to destroy the capsules and bring the photo-oxidizing agent and the reducing agent into contact with each other. Further, the fixing process can be greatly simplified by encapsulating the leuco dye and the photo-oxidizing agent into a heat-responsive microcapsule. That is, a recording material which is capable of forming a color by exposure with light and of fixing by heat can be prepared by encapsulating the leuco dye and the photo-oxidizing agent into the heat-responsive microcapsule and coating it onto a support together with a dispersion of the heat-fusion reducing agent. Such recording material can record an image by exposure with light and be fixed by heat-treatment such as passing through it between hot-rollers to thereby permeate the reducing agent into the microcapsule.

In addition, a multicolor image may also be obtained by providing on a support at least two layers each containing heat-responsive microcapsules containing a photo-oxidizing agent and a leuco dye, and a reducing agent outside the capsules with the dyes in the respective layers being so selected that they form colors with different hues from each other, applying a thermal energy adapted for the microcapsules in respective layers to respond, then exposing the recording material with light.

Further, the multicolor image can be easily attained in the recording material utilizing the heat-responsive microcapsule. The multicolor recording material can be obtained, for example, by encapsulating the leuco dye which is capable of forming red color and the photo-oxidizing agent into the microcapsule having a response temperature lower than that of another kind of microcapsule, the leuco dye which is capable of forming green color and the photo-oxidizing agent into the microcapsule having a response temperature higher than that the one above, and coating these two kinds of microcapsules onto the support together with the dispersion of the reducing agent. By conducting imagewise heating at the lower temperature, imagewise heating at the higher temperature and all over exposure with light to the recording material, successively, the portion which has not been conducted any thermal recording is colored to black, the portion which has been recorded at the lower temperature is colored to green, and the portion which has been recorded at the higher temperature is not colored, thus the multicolor image is obtained.

The response temperature of the heat-responsive microcapsule as mentioned herein means the temperature of which the reducing agent outside the microcapsules begin permeating into the microcapsules, and it varies depending upon a kind of the microcapsule wall-forming material, Tg (glass transition temperature), thickness of the microcapsule wall, the size of microcapsule, and so on.

Furthermore, more advanced multicolor recording system can be constructed by combining techniques as mentioned above. For example, the multicolor recording material can be obtained by coating onto the support the microcapsules having the heat response temperature higher than that of the another kind of microcapsule and containing the leuco dye which is capable of forming red color and the photo-oxidizing agent which responds to the light having wavelength of 380 nm or below, another microcapsules having the heat response temperature lower than that of the one above and containing the leuco dye which is capable of forming green color and the photo-oxidizing agent which responds to the light having wavelength of 500 nm or below, and the dispersion of the reducing agent. The multicolor image can be recorded to the recording material thus obtained by the following manner. First, imagewise heating at the response temperature of the microcapsule having the lower response temperature and exposure with the light having wavelength of from 380 to 500 nm are successively conducted to the recording material to obtain the image in which the portion which has not been imagewise heated is colored to green. Next, imagewise heating at the response temperature of the microcapsule having the higher response temperature and exposure with the light having wavelength of 380 nm or below are successively conducted to the recording material to obtain the image in which the portion which has not been imagewise heated is colored to red. In this manner, the green colored image is not disclosed even if the higher temperature is applied thereto since color formation reaction of green color has been completed at the portion. Therefore, three colors, i.e., green, red and black (the mixture of green with red), can be reproduced in the recording material of the present invention. Further, image density of the image obtained can be varied by controlling the temperature of imagewise heating to control the amount of the reducing agent to be permeating into the microcapsules.

Still further, the recording material, which can form a full-colored image by utilizing heat and light, can be obtained by utilizing three kinds of heat-responsive microcapsules which have different response temperature from each other, each containing a leuco dye and a photo-oxidizing agent, wherein the leuco dyes contained in each kind of the microcapsule are capable of forming different color from each other and they are yellow, magenta or cyan, respectively, and the photo-oxidizing agents contained in each kind of the microcapsule respond to the light having different wavelength from each other.

In order to obtain distinct photo-separation in the multicolor recording system as mentioned above, difference between responsive light wavelength of the photo-oxidizing agents contained in each microcapsule is preferably at least 20 nm, more preferably at least 40 nm.

It is preferred that, when the image is recorded by heating, the difference between each response temperature of the microcapsules is 20° C. or more.

Alternatively, the effect as obtained by utilizing the heat-responsive microcapsule can be also attained in the multi-layer recording material by piling up color forming layers successively. That is, the furthest color forming layer from the support can be recorded the image at the most lower temperature, and the closest color forming layer to the support can be recorded at the highest temperature.

As is described above, recording materials containing the photo-oxidizing agent and the leuco dye which is capable of forming a color by oxidation as major components enable one to realize multicolor recording in various manners.

The leuco dyes which can be used in the present invention include, for example, those which are described in U.S. Pat. No. 3,445,234, and typical structures thereof are illustrated below:

(1) Aminotriarylmethane;
(2) Aminoxanthene;
(3) Aminothioxanthene;
(4) Amino-9,10-dihydroacridine;
(5) Aminophenoxazine;
(6) Aminophenothiazine;
(7) Aminodihydrophenazine;
(8) Aminodiphenylmethane;
(9) Leucoindamine;
(10) Aminohydrocinnamic acid (cyanoethane, leucomethine);
(11) Hydrazine;
(12) Leucoindigoid dyes;
(13) Amino-2,3-dihydroanthraquinone;
(14) Tetrahalo-p,p'-biphenol;
(15) 2-(p-Hydroxyphenyl)-4,5-diphenylimidazole; and
(16) Phenethylaniline.

Of these leuco dyes, (1) to (9) form dyes when they lose one hydrogen atom, and (10) to (16) dyes when they lose two hydrogen atoms.

Specifically, there can be illustrated Crystal Violet, tris(4-diethylamino-o-tolyl)methane, bis(4-diethylamino-o-tolyl)phenylmethane, bis(4-diethylamino-o-tolyl)-thienyl-2-methane, bis(2-chloro-4-diethylaminophenyl)phenylmethane, 2-(2-chlorophenyl-)amino-6-N,N-dibutylamino-9-(2-methoxycarbonyl)-phenylxanthene, 2-N,N-dibenzylamino-6-N,N-dithylamino-9-(2-methoxycarbonyl)phenylxanthene, benzo[a]-6-N,N-diethylamino-9-(2-methoxycarbonyl)-phenylxanthene, 2-(2chloro-phenyl)-amino-6-N,N-dibutylamino-9-(2-methylphenylcarboxamido)phenylxanthene, 3,6-dimethoxy-9(2-methoxycarbonyl)phenylxanthene, 3,6-diethoxyethyl-9-(2 -methoxycarbonyl)-phenylxanthene, benzoyl leucomethylene blue, 3,7-bis-diethylaminophenoxazine, etc.

On the other hand, preferable photo-oxidizing agents to be used as the image-forming materials of the present invention include those which are usually inactive but, when irradiated with actinic radiation such as visible light rays, ultraviolet rays, infrared rays or X rays, produce a chemical substance capable of oxidizing the leuco dyes to their colored forms.

As typical examples of the photo-oxidizing agents, there are illustrated lophine dimer compounds such as 2,4,5-triarylimidazole dimers as described in JP-B-62-39728 (corresponding to U.S. Pat. No. 4,247,618) and JP-B-63-2099 (corresponding to U.S. Pat. No. 4,311,783); azide compounds such as 2-azidobenzoxazole, benzoylazide and 2-azidobenzimidazole as described in U.S. Pat. No. 3,282,693; pyridinium compounds such as 3'-ethyl-1-methoxy-2-pyridothiacyanine perchlorate and 1-methoxy-2-methylpyridinium-p-toluenesulfonate, and organic halogen compounds such as N-bromosuccinimide, tribromomethyl phenyl sulfone, diphenyliodide, 2-trichloromethyl-5-(p-butoxystyryl)-1,3,4-oxadiazole and 2,6-di-trichloromethyl-4-(p-methoxyphenyl)triazine, as described in U.S. Pat. No. 3,615,568; azide polymers as described in *Nihon Shashin Gakkai* 1968-*nen Syunki Kenkyu Happyokai Koenyoshisyu,* p55 (1968). Of these compounds, lophine dimer compounds and organic halogen compounds are preferable, and a combination of the two is more preferable since it provides a high sensitivity.

In preparing the image-forming material of the present invention, the leuco dye and the photo-oxidizing agent are mixed in a proportion of preferably 10:1 to 1:10, more preferably 2:1 to 1:2, in molar ratio.

In the case of using microcapsules according to the present invention, wall-forming agents such as gelatin, polyurea, polyimides, polyesters, polycarbonates, melamine, etc. may be used. In order to impart heat-responding properties to capsule walls, it suffices for the capsule wall to have a Tg of from room temperature to 200° C., preferably from 70° C. to 150° C.

In order to control the glass transition temperature of the capsule wall, a kind of capsule wall-forming material is properly selected. As preferred examples of the wall-forming material, there are illustrated polyurethane, polyurea, polyamide, polyester, polycarbonate, etc., and among them, polyurethane and polyurea are particularly preferable.

Microcapsules to be used in the present invention are formed by emulsifying a core substance (generally a solution of a hydrophobic solvent) containing image-forming substances such as a leuco dye and a photo-oxidizing agent, and forming a high polymer substance wall around the emulsified oil droplets. In this case, wall-forming reactants are added to the inside and/or outside of the oil droplets.

As a process for forming microcapsule walls of the present invention, an microencapsulation process by polymerization of reactants from inside of the oil droplets enables one to obtain, particularly within a short time, microcapsules of uniform size capable of forming recording materials with an excellent shelf life.

Techniques of microencapsulation, materials and specific examples of compounds to be used are described in U.S. Pat. Nos. 3,276,804 and 3,796,696.

For example, in the case of using polyurethane or polyurea as a capsule wall-forming material, a polyvalent isocyanate and a second substance capable of reacting with the polyvalent isocyanate to form a capsule wall (for example, polyol or polyamine) are mixed in an aqueous phase or in an oily liquid to be encapsulated, and the resulting solution is emulsified and dispersed in water, followed by increasing the temperature to cause a high polymer-forming reaction at the interface of the oily droplets, for forming microcapsule walls.

Glass transition point of the capsule wall can be greatly changed by properly selecting the first wall-forming substance, polyisocyanate, and the second wall-forming substance, polyol or polyamine.

As an organic solvent constituting the core of the capsules, high-boiling oils are used. Specific examples thereof include phosphoric acid esters, phthalic acid esters, acrylic acid esters and methacrylic acid esters, other carboxylic acids, fatty acid amides, alkylated biphenyls, alkylated terphenyls, alkylated naphthalenes, diarylethanes, chlorinated paraffins, etc.

The above-described organic solvents may be used in combination with a low-boiling auxiliary solvent. Specific examples of the auxiliary solvent include ethyl acetate, isopropyl acetate, butyl acetate, methylene chloride, cyclohexanone, etc.

In order to form stable emulsified oil droplets, a protective colloid or a surfactant may be added to the aqueous phase. As the protective colloid, water-soluble high polymers are generally usable.

In the present invention, the microcapsules have a size of from 20 to 0.3 μm, more preferably from 4 to 0.8 μm, in volume average value, for improvement of image resolving power and handling ease.

Thickness of the wall of the microcapsules is generally preferably from 0.05 to 1 μm, more preferably from 0.1 to 0.5 μm, though it depends upon the kind of the microcapsule wall-forming material and the size of the microcapsules. If it is less than 0.05 μm, insulating action of the wall between core substances and outside of the microcapsule is insufficient, thus the desired performance of the microcapsule can not be obtained since the core substances permeate to outside of the microcapsule, or outside substances permeate into the inside of the microcapsules. Alternatively, if it exceeds 1 μm, improvement in permeability of the wall cannot occur immediately at the heating process.

Then, in order to fix the image-forming material of the present invention, it suffices to inhibit activation of the photo-oxidizing agent. Active reducing agents are used for this purpose. A reducing agent allowed to exist in the vicinity of the photo-oxidizing agent can immediately reduce the activated photo-oxidizing agent so it loses the ability to oxidize the leuco dye. That is, such reducing agent functions as a so-called free radical scavenger which traps the free radical of the activated photo-oxidizing agent.

As specific examples of the reducing agent, there are illustrated hydroquinone compounds and aminophenol compounds which have a hydroxy group in the benzene ring and at least another hydroxy group or amino group in a different position of the benzene ring, as described in U.S. Pat. No. 3,042,515; cyclic phenylhydrazide compounds, compounds selected from among guanidine derivatives, alkylenediamine derivatives and hydroxyamine derivatives, as described in JP-B-62-39738. These compounds may be used alone or as a combination of two or more. However, these examples are not limitative at all, and other known reducing substances which possess the function of acting on or reacting with oxidants may also be used.

In the image-forming material of the present invention, the reducing agent is used in an amount of 1 to 100 mols, preferably 5 to 20 mols, per mol of the photo-oxidizing agent component.

In the present invention, known sensitizing agents, ultraviolet ray absorbents and anti-oxidants may be used as additional components for the photo-oxidizing agent.

In addition, aids may be used for the purpose of freely controlling the thermal recording or thermal fixing. Such aids function to decrease the melting points of individual components constituting the system or decrease glass transition points of the capsule walls.

Such aids include phenol compounds, alcohol compounds, amide compounds, sulfonamide compounds, etc. These compounds may be incorporated in the core substance or may be added as a dispersion outside the microcapsules.

Preparation of the multicolor recording material of the present invention is exemplified below using a microcapsule-containing embodiment.

The leuco dye and the photo-oxidizing agent are dissolved in a high-boiling solvent. To this high-boiling solvent are further added, if necessary, an organic acid capable of accelerating the coloration reaction, an anti-oxidant for inhibiting the reaction before use, an ultraviolet ray absorbent for controlling wavelength re of light used for exposure, and the like. Still further, a capsule wall-forming material such as an isocyanate is added thereto. In this situation, a low-boiling solvent may be used in some cases as a dissolving aid. The resulting oil is poured into a solution of a water-soluble high polymer, then vigorously stirred by means of a homogenizer or the like for emulsification. A capsule wall-forming material of a polyol or the like is further added to the emulsion, and the resulting mixture is heated to form capsule walls at the interface between oil and aqueous phases.

The reducing agent is generally finely pulverized to a size of several μm in a water-soluble high polymer solution using a wet-process dispersing machine such as a ball mill or sand mill.

The capsule solution and the dispersion of reducing agent are mixed with each other to prepare a coating solution. In order to realize multicolor recording, two or more kinds of such coating solutions providing different hues must be prepared.

The coating solutions are coated on a support. In this situation, to the above-described coating solution may further be added a binder for the purpose of enhancing strength of the coating film, an organic or inorganic pigment for improving whiteness of the coated surface, and a wax, a metallic soap or a surfactant for improving handling properties and preventing adhesion to a heat source such as a thermal drum, thermal head, etc. upon heating.

The coating amount of the image-forming layer in the present invention is 0.1 to 2 $g/m^2$, particularly preferably 0.2 to 1 $g/m^2$ calculated as solid leuco dye.

In case of that the recording material of the present invention is applied to a heat recording system utilizing a thermal head, it is preferred that a surface protective layer is provided at the top of the recording material to prevent contamination of the thermal head or adhesion of the thermal head with the recording material. Further, in case of that the recording material of the present invention take the multi-layer structure, it is preferred that an interlayer is provided between the color forming layers to prevent to mixing each color forming layers.

Furthermore, a back coating layer may be provided onto the back of the recording material of the present invention in order to improve running property at the recording, prevent electrification, take a curl balance thereof, and so on.

As materials suitable as a support, there are illustrated papers, regenerated cellulose, cellulose acetate, cellulose nitrate, plastic resins such as polyethylene terephthalate, polyethylene, polyvinyl acetate, polymethyl methacrylate and polyvinyl chloride, synthetic papers, etc.

As methods for coating the solution on the support, there are illustrated an air-knife coating method, a curtain coating method, a slide coating method, a roller coating method, a dip-coating method, a wire-bar coating method, a blade coating method, a gravure coating method, a spin coating method, and an extrusion coating method which, however, are not limitative at all.

In the present invention, formation of an image by heating is the same as with ordinary thermal recording and may be conducted by using a thermal pen or a thermal head.

In the case of recording using light, a fluorescent lamp, a mercury lamp, a metal halide lamp, a xenon lamp, a tungsten lamp, etc. may be used as a light source. In addition, ultraviolet ray-emitting laser may also be used.

The multicolor recording material of the present invention is characterized in that it is excellent in shelf life and coloration density and that a multicolor image can be easily obtained.

The present invention is now illustrated in more detail by reference to the following examples which, however, are not to be construed as limiting the present invention in any way. Additionally, "parts" showing amounts to be added are by weight.

EXAMPLE 1

Preparation of Capsule Solution A

| | |
|---|---|
| Leuco dye (forming blue color): Leuco Crystal Violet | 1.0 part |
| Photo-oxidizing agent: 2,2'-Bis-(o-chlorophenyl)-4,4',5,5' tetraphenylimidazole | 2.0 parts |
| Additives: | |
| Dodecylbenzenesulfonic acid | 0.4 part |
| 2,5-Di-tert-octylhydroquinone | 0.6 part |
| Capsule wall-forming material: Xylylenediisocyanate/trimethylolpropane adduct | 15 parts |
| Auxiliary solvent: Ethyl acetate | 20 parts |
| High boiling solvent: Tricresyl phosphate | 18 parts |

A uniform solution was prepared from the above-described ingredients. This solution was added to 54 parts of a 6% aqueous solution of polyvinyl alcohol (polymerization degree: 1700; saponification degree: 88%), and emulsified and dispersed at 20° C. in a homogenizer to obtain an emulsion of 1 μm in average particle size. 68 Parts of water was added to the resulting emulsion, followed by continuing stirring for 3 hours at 40° C. The temperature was then restored to room temperature to obtain capsule solution A.

Preparation of Capsule Solution B

Capsule solution B was prepared according to the same formulation as with capsule solution A except for changing the leuco dye to 3,6-dimethoxy-9-(2-methoxycarbonyl)phenylxanthene and the photo-oxidizing agent to diphenyliodide hexafluorophosphate.

Preparation of a Dispersion of Reducing Agent

30 Parts of 1-phenylpyrazolidin-3-one (Phenidone A) was added to 150 parts of the above-described 4% by weight aqueous solution of polyvinyl alcohol, then subjected to a dispersing step using a horizontal sand mill to obtain a Phenidone A dispersion of 1 μm in average particle size.

Then, a coating solution of the following formulation was prepared.

| | |
|---|---|
| Capsule solution A described above | 6.8 parts |
| Capsule solution B described above | 6.8 parts |
| Reducing agent dispersion described above | 6.0 parts |

This coating solution was coated on woodfree paper (basis weight: 76 g/m$^2$) in a leuco dye amount of 0.2 g/m$^2$ using a coating rod, then dried at 50° C. to obtain a multicolor recording material in accordance with the present invention.

A photographic original for making a printing plate was superposed on the thus-obtained recording sheet, and exposure was conducted using 460 nm light until the exposed portion became a blue color. Subsequently, another original was superposed thereon and, after exposing with 360 nm light until exposed portions became a green color, the recording sheet was heated using a 120° C. heated roller to fix it.

Thus, there was obtained an image with vivid two colors of blue and green.

EXAMPLE 2

The following solutions were prepared using the capsule solution and the dispersions used in Example 1.

| | |
|---|---|
| Coating solution C: | |
| Capsule solution B described above | 6.8 parts |
| Reducing agent dispersion described above | 3.0 parts |
| Coating solution D: | |
| Capsule solution A described above | 6.8 parts |
| Reducing agent dispersion described above | 3.0 parts |

Coating solution C was coated on woodfree paper (basis weight: 76 g/m$^2$) in a leuco dye amount of 0.25 g/m$^2$ using a coating rod, then dried at 50° C. A 5% aqueous solution of polyvinyl alcohol was coated thereon in a solid amount of 0.2 g/m$^2$, and coating solution D was further coated thereon in a leuco dye amount of 0.25 g/m$^2$ to obtain a multicolor recording material of the present invention.

The thus obtained recording sheet was printed at two printing energy levels of 20 mJ/mm$^2$ and 40 mJ/mm$^2$ using a printing tester equipped with a KJT type thermal head made by Kyocera Corporation, then subjected to all over exposure. Thus, portions not printed at all gained a green color, portions printed at an energy level of 20 mJ/mm$^2$ gained a yellow color, and portions printed at an energy level of 40 mJ/mm$^2$ appeared almost colorless to attain multicolor recording.

EXAMPLE 3

In the procedures described in Example 2, printing at an energy level of 20 mJ/mm$^2$ was followed by all-over exposure using a 460 nm light, and printing at an energy level of 40 mJ/mm$^2$ was followed by all-over exposure using a 360 nm light to obtain a multicolor image wherein portions not printed at all gained a green color, portions printed at an energy level of 20 mJ/mm$^2$ gained a yellow color, portions printed at an energy level of 40 mJ/mm$^2$ gained a blue color, and portions printed in an overlapped manner at energy levels of 20 mJ/mm$^2$ and 40 mJ/mm$^2$ appeared almost colorless.

As is apparent from this Example, the present invention enables one to easily obtain multicolor images. In addition, multicolor recording with more colors can be attained by increasing the number of combinations of leuco dyes and photo-oxidizing agents.

While the present invention has been described in detail and with reference to specific embodiments thereof, it is apparent to one skilled in the art that various changes and modifications can be made therein without departing from the spirit and the scope of the present invention.

What is claimed is:

1. A multicolor recording material comprising a support having provided thereon at least two layers each containing a leuco dye which is capable of forming a color by oxidation and a photo-oxidizing agent, wherein said leuco dyes contained in each layer are capable of forming different color from each other and said photo-oxidizing agents contained in each layer respond to light having different wavelength from each other.

2. A multicolor recording material comprising a support having provided thereon a layer containing at least two kinds of heat-responsive microcapsules which have different response temperature from each other, each containing a leuco dye which is capable of forming a color by oxidation and a photo-oxidizing agent, wherein said leuco dyes contained in each kind of microcapsule are capable of forming different color from each other and said photo-oxidizing agents contained in each kind of microcapsule respond to light having different wavelength from each other.

3. A multicolor recording material as claimed in claim 1, wherein in each said at least two layers, said leuco dye and said photo-oxidizing agent are contained together in microcapsules.

4. A multicolor recording material as claimed in claim 1, wherein each of said layers contains a reducing agent.

5. A multicolor recording material as claimed in claim 2, wherein said layer contains a reducing agent existing outside the microcapsules.

6. A multicolor recording material as claimed in claim 3, wherein each of said layers contains a reducing agent existing outside the microcapsules.

* * * * *